United States Patent [19]

Fukuyama

[11] Patent Number: 4,854,928

[45] Date of Patent: Aug. 8, 1989

[54] METHOD AND APPARATUS FOR TRANSFERRING AND BUNDLING PLASTIC BAG SHEET MATERIAL

[75] Inventor: Yoshiaki Fukuyama, Kawagoe, Japan

[73] Assignee: Nippon Flute Co., Ltd., Irumagun, Japan

[21] Appl. No.: 81,678

[22] Filed: Aug. 5, 1987

[30] Foreign Application Priority Data

Aug. 5, 1986 [JP] Japan ..... 61-184030

[51] Int. Cl.[4] ..... B31B 1/00

[52] U.S. Cl. ..... 493/28; 493/29; 493/194; 493/204

[58] Field of Search ..... 493/28, 29, 194, 199, 493/203, 204, 35; 156/515; 83/90, 91, 358; 271/176, 182

[56] References Cited

U.S. PATENT DOCUMENTS

| | | | |
|---|---|---|---|
| 3,580,142 | 5/1971 | Stock | 493/35 |
| 4,070,951 | 1/1978 | Bala | 493/29 |
| 4,073,223 | 2/1978 | Crawford | 274/183 |
| 4,133,523 | 1/1979 | Berthelot | 271/182 |
| 4,207,667 | 6/1980 | D'Angelo et al. | 83/91 |

*Primary Examiner*—Frederick R. Schmidt
*Assistant Examiner*—Robert Showalter
*Attorney, Agent, or Firm*—Bradford F. Kile

[57] ABSTRACT

A method and apparatus for transferring and bundling plastic bag sheet material wherein bag cycle speed is automatically slowed, but not stopped, during a bundle transfer operation and cycle speed is resumed after one slow speed bag production cycle.

5 Claims, 2 Drawing Sheets

METHOD AND APPARATUS FOR TRANSFERRING AND BUNDLING PLASTIC BAG SHEET MATERIAL

BACKGROUND OF THE INVENTION

This invention relates to a method and apparatus for making thermoplastic bags. More specifically, this invention relates to a method and apparatus for transferring and bundling thermoplastic bags of the type used to sack consumer goods in a grocery store, convenience store, drug store and the like.

Thermoplastic convenience bags have gradually gained acceptance by the retail industry and have completely replaced the utilization of paper bags in many market areas. A typical plastic bag includes a heat sealed bottom and integral carrying handles adjacent a top opening portion prompting some to descriptively refer to the bags as plastic tee-shirt bags.

In the past, tee shirt and other plastic bags have been manufactured by high speed processing machines wherein a roll of tubular thermoplastic stock is mounted upon one end of the machine and stacks or bundles of completed bags exit from an opposite end of the machine for packing. More specifically, the tubular plastic is unreeled by a pair of opposing drive or nip rolls which are coupled to an electric motor through a clutch and brake mechanism. The drive rolls are thereby suitable to be intermittently stopped and started to advance the plastic tubular stock at a predetermined rate and pattern of control. A cutting and sealing station is positioned downstream from the drive rolls and includes a first heat sealing strip, an intermediate, heated, cutting knife and a parallel, bottom heat, sealing strip. Actuation of the sealing and cutting mechanism is synchronously controlled with the advancement of the tubular stock so that the stock is stopped during a cutting and sealing operation, and the bag is sealed and cut and then advanced a predetermined length. The process is repeated in a rapid manner at a rate of approximately 120 to 150 bags per minute.

Downstream of the cutting and sealing station is a stack or bundle forming mechanism wherein a plurality of bags are stacked into a neat arrangement until a predetermined number is formed into a bundle for further transfer, processing and packing.

One previously known thermoplastic bag making machine, of the type generally described above, is illustrated in U.S. Pat. No. 3,580,142. In this patent disclosure, sheet material, which is flattened synthetic resin tubing, is transferred in specific lengths to a sealing and cutting station. Production of a single bag is referred to as a bag making cycle. After each cycle the completed bags are stacked to form a bundle. When the number of bags in a bundle reaches a specified total, the bag making operation is temporarily stopped or interrupted and the bundle of plastic bags is transferred by a transferring mechanism to an index conveyor where completed bundles are formed into a shingle array for further handling and packing.

In accordance with one previously known device, the bag making operation was stopped for one bag making cycle to permit operation of the transferring mechanism for a bundle. In another machine, such as the '142 patented structure, the duration of the stoppage was selected to be independent of one bag making cycle. In both instances, however, with previously known machines, bag production is temporarily stopped to prevent the thin bag material from becoming jammed during a bundle transfer operation. As a result of this stopping, to perform the transfer operation, production of the bag making operation was suspended which resulted in a reduction in production efficiency.

Although the production of thermoplastic bags in accordance with previously known techniques has achieved a degree of success and industry recognition. It has been found that production in accordance with conventional techniques is limited to approximately to 150 cycles per minute. Increasing the bag making cycle tends to increase a tendency for mis-alignment, wrinkling, and jamming of the relatively thin bags as well as increasing the wear on various moving components. In addition, it has been found that in operating machinery with a fixed bag production cycle, that operators have tended to remove damaged or jammed bags or material during the rapid bag making operation of the machine without stopping the bag making machine. Attempting to clear fouled material during full speed bag making can present a significant safety hazard.

Still further, conventional plastic bag making machinery, which runs at a constant speed, can present setup problems in the sense that the machine produces bags at such a rapid rate that it is difficult to visually perceive and verify the correctness of a single bag making operation.

The difficulties suggested in the proceeding are not intended to be exhaustive but rather are among many which tend to reduce the effectiveness and user satisfaction with prior methods and apparatus for transferring and bundling plastic bags. Other noteworthy problems may also exist; however, those presented above should be sufficient to demonstrate that thin, plastic bag making methods and apparatus appearing in the past will admit to worthwhile improvement.

OBJECTS OF THE INVENTION

It is therefore a general object of the invention to provide a novel method and apparatus for transferring and bundling thermoplastic bags which will obviate or minimize difficulties of the type previously described.

It is a specific object of the invention to provide a novel method and apparatus for transferring and bundling plastic bag sheet material wherein adjustments to the bag making operation may be effected without bringing the entire bag production operation to a halt.

It is another object of the invention to provide a novel method and apparatus for transferring and bundling plastic bag sheet material wherein the bag making operation need not be terminated during bundle transfer It is a related object of the invention to provide a novel method and apparatus for transferring and bundling plastic bag material wherein bundle transfer may be advantageously achieved while concomitantly and economically maintaining bag production.

It is a related object of the invention to provide a novel method and apparatus for transferring and bundling plastic bag sheet material wherein bag production may be accurately monitored to permit minor adjustments with visual confirmation.

It is yet another object of the invention to provide a novel method and apparatus for transferring and bundling thermoplastic bag sheet material wherein control of the tubular sheet material feeding operation is advantageously monitored and maintained without stopping the bag making process.

BRIEF SUMMARY OF A PREFERRED EMBODIMENT OF THE INVENTION

One preferred embodiment of the invention which is intended to accomplish the foregoing objects includes a method and apparatus wherein drive rolls for a thermoplastic bag making machine are monitored and upon reaching a predetermined number of bag making cycles, the drive rolls are slowed, without stopping, to permit a bundle transfer operation to be synchronously performed.

Since the drive rolls and thus bag production is not stopped during the transfer operation, but rather is merely slowed to a "creep speed", bag production can be visually monitored, wrinkle producing phenomena identified and the time spent in machine production down time, during bundle transfer, minimized.

THE DRAWINGS

Other objects and advantages of the present invention will become apparent from the following detailed description of a preferred embodiment taken in conjunction with the accompanying drawings, wherein:

FIG. 1 is a schematic illustration of a thermoplastic bag making apparatus in accordance with the subject invention wherein a pair of opposing nip or drive rolls are electronically monitored and controlled to slow bag production, without stopping production, during a plastic bag bundle transfer sequence; and FIGS. 2A through 2K disclose timing charts for bag making production and the control state of various components.

DETAILED DESCRIPTION

Structure

Figure 1:
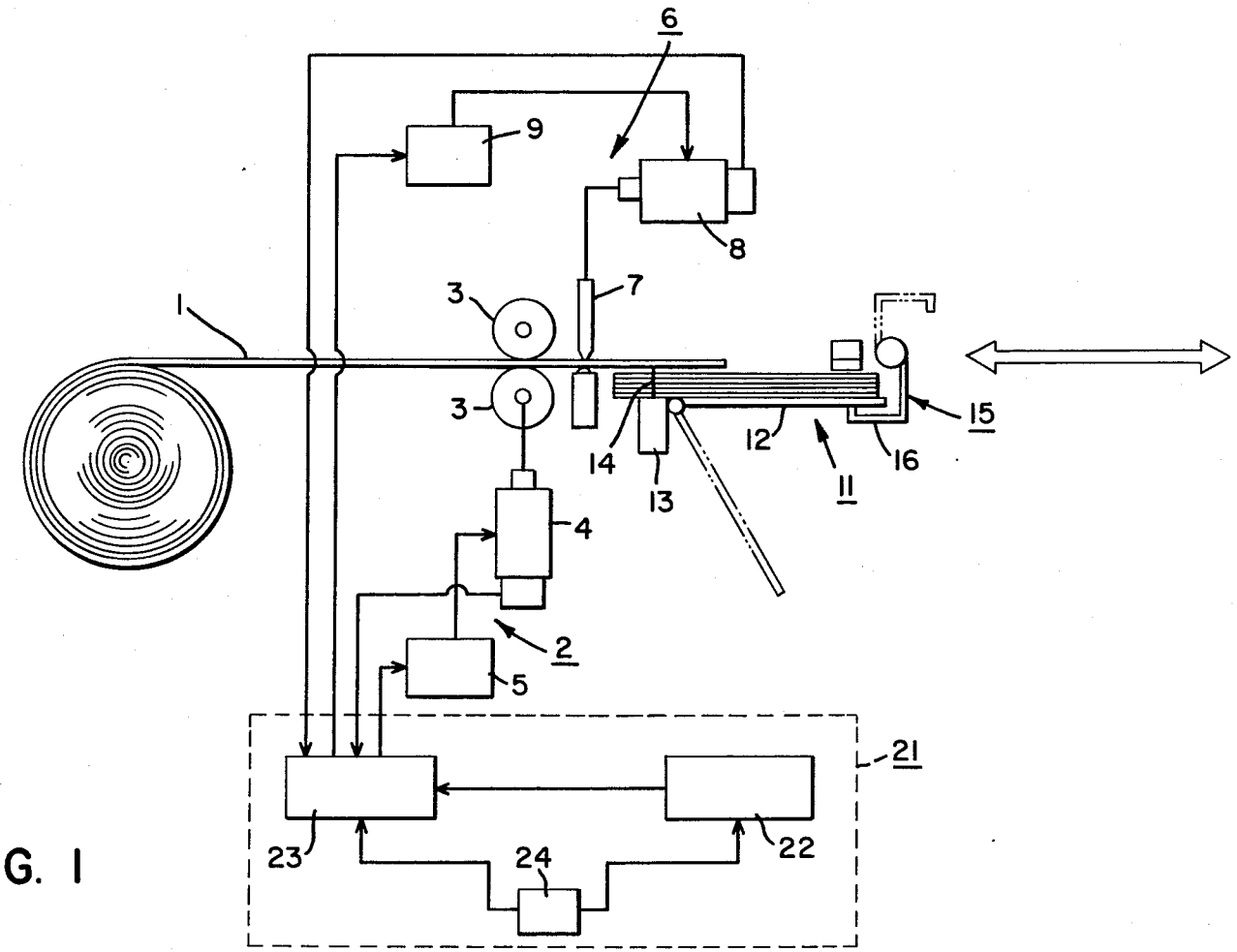

Referring now to the drawings and initially to FIG. 1, there will be seen a schematic illustration of a thin, plastic, bag making machine in accordance with the subject invention.

More specifically, a relatively large role of sheet material 1 is produced, in an independent operation, in a continuous tubular length. The sheet material is rolled into flattened tubular stock for processing into plastic bags. The tubular stock is composed of conventional synthetic resins such as a thermoplastic material As further shown in FIG. 1, the role of plastic tubular stock is unwound and fed into a transferring mechanism 2 which comprises a pair of opposing nip rollers 3 which operably hold the sheet material between the roles. The rolls are driven by an electric servo motor 4 which is mechanically attached to the rollers. The motor 4 in turn is controlled by a servo driver 5.

A sealing and cutting mechanism 6 is mounted downstream of the nip rolls and comprises a servo motor 8 which is connected to a heated cutter bar 7. The cutting bar cuts the sheet stock material in a conventional manner. A servo driver 9 is connected to the cutting motor 8 and operably controls the same.

A bundling mechanism 11 is mounted adjacent to the sealing and cutting station and provides a mechanism for stacking and accumulated bags. The bundling mechanism 11 includes a sheet receiving table 12 which is operable to swing from a horizontal posture as shown in FIG. 1 to a downward inclined position as represented in phantom lines in FIG. 1. The bags are stacked upon a pair of needles 14 which are controlled by solenoids 13 in a conventional manner.

A transferring mechanism 15 includes a holding arm 16 which is able to move forward and backward and assist in a conventional manner in transferring a completed bundle of bags away from the stacking station upon withdrawal of the stacking pins 14.

The subject apparatus advantageously includes an electronic control unit 21 which includes a sequence module 22 and a positioning unit 23 attached to the sequence module. The control unit 21 further includes a length position and bundle setting counter 24 which is connected to both the sequencing device 22 and positioning unit 23. As seen in FIG. 1, the positioning 23 is attached to the servo drivers 5 and 9 to input signals to the transferring motor 4 and cutting motor 8 respectively.

Sequence of Operation

Figure 2:
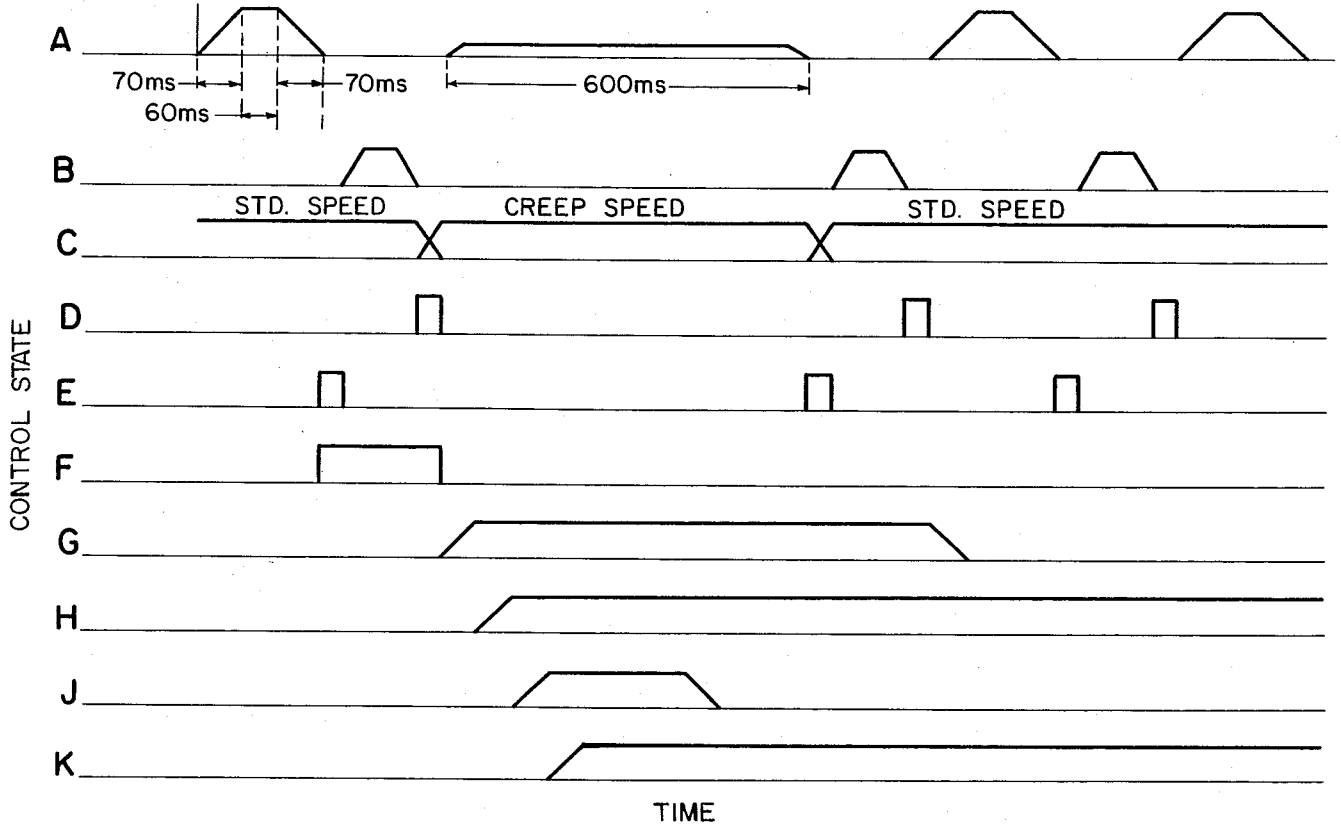

Turning to FIG. 2, and in cooperation with the elements discussed in FIG. 1, a sequence of operation of the subject invention may be appreciated. More specifically, an operation switch is thrown, not shown, and a signal is sent to the positioning device 23 from the sequence module 22 of the control unit. The positioning device 23 sends a driving signal to the servo driver 5 and the servo driver 5 actuates the transferring motor 4, note FIG. 2(A). The sheet material is thus transferred by drive rollers 3 at a standard speed, note FIG. 2(C).

A feedback signal pulse is sent to the positioning device 23 from the transferring motor 4 and the positioning device 23 drives rollers 3 to a specific value which is controlled by a length specifying switch, not shown. Pulses are counted up to a specified set value by the length specifying switch and the transferring rollers 3 are stopped to terminate advance of the sheet material when the specified value is counted. At the same time, that the transferring motor 4 sends a transfer completion signal to the positioning device 23, note FIG. 2(E), the positioning device 23 sends a transfer completion signal to the servo driver 9 of the cutting and sealing motor 8. The servo motor 8 then drives the cutting and sealing bar 7, note FIG. 2(B) and the sheet material is cut and sealed to the specified length by the cutter 7.

Upon completion of the cutting operation, a signal is sent from the cutting motor 8 to the positioning device 23, note FIG. 2(D), and the transferring mechanism 2 is again driven and sequencing control is performed by the sequencing device 22.

In accordance with the above, the operation is rapidly repeated and the transferring, cutting and sealing are performed to produce a plurality of identical plastic bags.

As each bag is produced, the needles 14 pierce an upper edge of the bag and forms a neat stack of formed bags on the receiving table 12. During the bag making cycles, a bundle counter 24 counts the number of the sheet material advances and sends a signal to the sequence device 22 and positioning device 23 when the number reaches a specified value, note FIG. 2(F).

The sequence device 22 processes and sends a speed selection signal to the positioning device 23, note FIG. 2(C), and a relatively slow speed instruction is sent to the servo driver 5 of the transferring device 2. The transferring motor 4 then rotates at a designated relative slow speed for 600 milliseconds, FIG. 2(A). The stock sheet material is thus advanced at a relatively slower speed which is reduced from the standard speed, note FIG. 2(C). During bundle transfer, the count up signal drives the sheet receiving table 12 upward, note FIG.

2(G), and the holding arm 16 closes to keep the bundle of the bag sheets at the upper limit of the table movement, FIG. 2(H).

When the holding arm 16 holds the bundle of sheet material the sequence device 22 sends a closing completion signal, which is not shown in the diagram, to the solenoid 13 and the needle 14 descends to pull the needle out from the bundle, FIG. 2(J). A lower limit signal is then sent to the sequence device 22 when the needle journeys to the down limit, to remove the holding needle 16, FIG. 2(K). Then the bundle of the sheet material is transferred to the right as shown in FIG. 1.

During this bundle transfer period, the succeeding segment of sheet material, which is advancing at a reduced speed, becomes the first bag of the next bundle. Upon transfer completion a signal is sent when the sheet material reaches a specified length, FIG. 2(E). The slowed speed of the transfer motor 4 is released and the cutting motor 8 is driven. The speed of the transferring motor 4 resumes a normal continuous operation speed and advances the sheet material at the standard rate.

The following is an example of an actual preferred operation. The operation period of the transfer motor 4 is 70 milliseconds (ms) for acceleration, 60 ms for normal operation, 70 ms for descending and thus a total time of 200 ms. The cutting motor operates for 120 ms with 40 ms for transfer completion signal"E" and 40 ms for cutting completion signal"D" for a total of 400 ms per bag production cycle. These periods allow a production quantity of 150 bags per minutes. On the other hand, the period of operation at the reduced speed, as instructed by the speed selection signal is 600 ms.

The response time of the solenoid 13 and the needle 14 is 10 ms and the operation period of the plunger of the solenoid 13 is 71.5 ms for a total operating time of 81.5 ms. Thus 100 ms is sufficient to retract and release the pins from a bundle of plastic bags.

To compare the production efficiency of the subject invention to conventional bag making apparatus; assuming a 24 hour operation for 25 days a month and that the stop period for each bundle transfer by convention apparatus is 2.5 seconds. By comparison, the creep speed transfer operation has been found to be facilely performed within 600 ms for transferring a bag bundle and restarting normal speed bag making.

With conventional methods and apparatus, producing 120 bags per minute, the actual production rate is 115 sacks when the 2.5 second stop period is considered. In a given month therefore the number of plastic bags produced may be computed as follows:

$$115\ (\text{sack/min.}) \times 60\ (\text{min.}) \times 24\ (\text{hours}) \times 25\ (\text{days}) = 4,140,000\ (\text{sacks/month})$$

In accordance with the subject invention, however, a greater number of plastic bags per month may be produced as follows:

$$120\ (\text{sacks/minutes}) \times 60\ (\text{min.}) \times 24\ (\text{hours}) \times 25\ (\text{days}) = 4,320,000\ (\text{sacks/month})$$

It will be noted by utilizing the subject continuous, but creep mode of operation, the number of bags per month may be increased by 180,000.

For a 150 bag per minute operation, a conventional machine will produce 5,184,000 (sacks/month) whereas the subject creep motion method and apparatus will produce 5,400,000 (sacks/month) which results in an increase in production of 252,000 (sacks/month). In a similar vein for a 200 sack per minute operation conventional apparatus will produce 6,912,000 (sacks per month) whereas the subject invention will produce 7,200,000 plastic bags per month for an increase of 288,000 sacks per month.

In addition to actuation of the creep motion of bag making during bundle transfer, the control unit 21 may be actuated by a manual switch, not shown, to selectively initiate one or more creep motion cycles to enable an operation to clear a jam, visually monitor misalignment problems, etc. as desired.

SUMMARY OF MAJOR ADVANTAGES OF THE INVENTION

After reading and understanding the foregoing description of the invention, in conjunction with the drawings, it will be appreciated that several distinct advantages are obtained.

Without attempting to set forth all of the desirable features of the instant method and apparatus for transferring and bundling plastic bags, at least some of the major advantages include the provision of a creep mode of one complete bag making operation, for 600 ms to permit transfer and bundling of stacks of bags.

In addition selective manual actuation of the creep mode of operation, by an operator, will permit safe removal of jammed sheet stock, as needed, without shutting down the line.

Additionally during the creep mode of one bag production, and automatic transfer of a bundle of bags, an operator may visually inspect and verify proper bag making functions and identify for correction troubling indications, if any, before a jam occurs.

In describing the invention, reference has been made to a preferred embodiment and illustrative advantages of the invention. Those skilled in the art, however, and familiar with the instant disclosure of the subject invention, may recognize additions, deletions, modifications, substitutions and/or other changes which will fall within purview of the subject invention and claims.

What is claimed is:

1. A method for transferring and bundling plastic bag sheet material comprising the steps of:

feeding plastic tubing to be processed into plastic bags from a feed roll;

advancing the plastic tubing through a drive roll mechanism for controllably advancing the tubing to a station for sealing and cutting;

intermittently cutting the tubing into pre-selected lengths and concomitantly sealing the bottom of a next adjacent bag;

temporarily storing a predetermined number of bags in a bundle;

counting the number of bag making cycles up to a predetermined number to complete a bundle;

transferring a bundle of completed bags away from the means for temporarily storing;

during said step of transferring, controlling said drive roll mechanism for maintaining a desired speed of advancement of the plastic tubing to be processed into plastic bags, controlling the timing of intermittent cutting and sealing, reducing the speed of said drive roll mechanism for one bag making cycle to permit removal of said completed bundle of plastic bags, without stopping said drive roll means, and upon reaching completion of a predetermined period of one bag making cycle during said step of transferring, resuming the speed of said drive roll mechanism.

2. A method for transferring and bundling plastic bag sheet material as defined in claim 1 and further comprising the step of:

timing the duration of reduced speed of the drive roll mechanism consistent with a predetermined time necessary to perform a transfer operation of a completed bundle of bags, and re-initiating full speed operation of the drive roll mechanism upon completion of one complete bag making cycle at a reduced speed during the transfer operation.

3. A method for transferring and bundling plastic bag sheet material as defined in claim 2 wherein said step of timing the duration of reduced speed of the drive roll comprises:

controlling the advancement of plastic tubing to produce a single bag during a 600 millisecond period.

4. An apparatus for transferring and bundling plastic bag sheet material comprising:

drive roll means for feeding plastic tubing from a feed roll to a bag sealing and cutting station;

means for intermittently cutting the tubing into preselected lengths and concomitantly sealing the bottom of a next adjacent bag;

means for temporarily storing a number of bags in a bundle;

means for transferring a bundle of bags away from the means for temporarily storing; and control means for maintaining a desired speed of said drive roll means during normal bag making and for controlling said means for intermittently cutting and sealing;

means for counting the number of bag making cycles; and means for slowing, without stopping, said drive roll means upon reaching a predetermined number of bag making cycles to permit removal of a bundle of bags.

5. An apparatus for transferring and bundling plastic bag sheet material as defined in claim 4 and further including:

means for timing the duration of reduced speed of said drive roll means for a period of 600 milliseconds for a single bag making cycle to perform a transfer operation of a completed bundle of bags.

* * * * *